US011653741B2

(12) United States Patent
Chevalier

(10) Patent No.: US 11,653,741 B2
(45) Date of Patent: May 23, 2023

(54) APPLICATOR DEVICE FOR COSMETIC PRODUCT WITH FLEXIBLE APPLICATOR ELEMENT

(71) Applicant: LVMH Recherche, Saint Jean de Braye (FR)

(72) Inventor: Marc Chevalier, Franconville (FR)

(73) Assignee: LVMH Recherche, Saint Jean Braye (FR)

( * ) Notice: Subject to any disclaimer, the term of this patent is extended or adjusted under 35 U.S.C. 154(b) by 637 days.

(21) Appl. No.: 16/472,729

(22) PCT Filed: Dec. 20, 2017

(86) PCT No.: PCT/FR2017/053748

§ 371 (c)(1),
(2) Date: Jun. 21, 2019

(87) PCT Pub. No.: WO2018/115752

PCT Pub. Date: Jun. 28, 2018

(65) Prior Publication Data

US 2021/0127814 A1 May 6, 2021

(30) Foreign Application Priority Data

Dec. 21, 2016 (FR) ..... 16 63088

(51) Int. Cl.

| | |
|---|---|
| ***A45D 40/26*** | (2006.01) |
| ***A46B 3/16*** | (2006.01) |
| ***A46B 5/00*** | (2006.01) |
| ***A46B 9/02*** | (2006.01) |

(52) U.S. Cl.

CPC ..... *A45D 40/265* (2013.01); *A45D 40/264* (2013.01); *A46B 3/16* (2013.01); *A46B 5/0066* (2013.01); *A46B 9/021* (2013.01); *A46B 2200/1053* (2013.01)

(58) Field of Classification Search

CPC .... A45D 40/26; A45D 40/262; A45D 40/265; A45D 40/264; A46B 9/021; A46B 2200/1053; A46B 5/0066

See application file for complete search history.

(56) References Cited

U.S. PATENT DOCUMENTS

| | | | |
|---|---|---|---|
| 2008/0107470 | A1 | 5/2008 | Gueret |
| 2013/0045039 | A1 | 2/2013 | Jeong |
| 2016/0143419 | A1 | 5/2016 | Sanchez et al. |

FOREIGN PATENT DOCUMENTS

| | | | |
|---|---|---|---|
| EP | 0811336 | A1 | 12/1997 |
| EP | 1935279 | A1 | 6/2008 |
| FR | 2945417 | A1 | 11/2010 |
| FR | 3004627 | A1 | 10/2014 |
| JP | 2006305191 | A | 11/2006 |
| JP | 2014140724 | A | 8/2014 |

OTHER PUBLICATIONS

International Search Report related to Application No. PCT/FR2017/053748; reported on Mar. 28, 2018.

*Primary Examiner* — Rachel R Steitz

(74) *Attorney, Agent, or Firm* — von Briesen & Roper, s.c.

(57) ABSTRACT

A device for a timepiece, comprising a support, an inertial regulating member mounted so as to rotate relative to the support by an elastic suspension connecting said regulating member to the support. The regulating member comprises a number n of rigid portions interconnected in pairs by n elastic coupling links. The elastic suspension comprises n elastic suspension links respectively connecting each rigid portion to the support.

21 Claims, 7 Drawing Sheets

APPLICATOR DEVICE FOR COSMETIC PRODUCT WITH FLEXIBLE APPLICATOR ELEMENT

CROSS-REFERENCE TO RELATED APPLICATION

This Application is a 35 USC § 371 US National Stage filing of International Application No. PCT/FR2021/0053748 filed on Dec. 20, 2017, and claims priority under the Paris Convention to French Patent Application No. 16 63088 filed on Dec. 21, 2016.

FIELD OF THE DISCLOSURE

The present invention relates to an applicator device and to a device for packaging and applying a cosmetic product to keratinous materials, in particular keratinous fibers such as eyelashes or eyebrows. The cosmetic product is in particular a mascara.

BACKGROUND OF THE DISCLOSURE

Patent application EP-A-1 935 279 describes an example of an applicator device for applying a product to keratinous fibers. This applicator device comprises a rod, an applicator member fixed to one end of the rod, and a rigid core extending in the extension of the rod. The core is attached to the rod or is created as one piece with the rod. The applicator device also comprises an outer shell with an attachment area and an application area. The outer shell defines an interior cavity into which the core is inserted. The outer shell is attached at one end of the rod by the attachment area and is free relative to the core, at least over a portion of the application area. The attachment area of the outer shell is fixed to the rod and to the core so as to be sandwiched between the rod and the core. The core may be flexible so as to provide flexibility when applying the product.

The arrangement proposed in this application EP-A-1 935 279 is complex and not very robust, however.

Patent application U.S. Pat. No. 2,008,107 470 describes an applicator device with an applicator element, a rigid rod, and a flexible part between the applicator element and the rigid rod. The applicator element has a rigid twisted core and transversely extending bristles. The rigid twisted core of the applicator element is fixed in a housing of the flexible part, which in turn is fixed in a housing formed at one end of the rod. The flexible part is elastically deformable. This assembly is also complex and not very robust.

International patent application WO-A-2013/034 638 describes a device substantially identical to the applicator device of application US-A-2008 107 470, intended to ensure the attachment of the rigid core of the applicator element. For this purpose, according to a first example, the core of the applicator element is fixed in a housing of the flexible part and held in position by a holding element surrounding a portion of the flexible part. In a second example, the core of the applicator element is fixed in a housing of the holding element, a portion of the flexible part being overmolded around the holding element.

The assembly proposed in this last application is complex, however, and therefore results in a high manufacturing cost.

SUMMARY OF THE DISCLOSURE

An object of the invention is to provide an applicator device not having at least some of the disadvantages indicated above. In particular, the invention aims to provide an applicator device comprising a flexible applicator element, which is of simple and robust design. Advantageously, the applicator device according to the invention can be used to apply any type of cosmetic product.

To this end, the invention provides an applicator device for applying a cosmetic product onto keratinous materials, in particular keratinous fibers such as eyelashes or eyebrows, comprising:

- a rod, the rod having a first and a second end, the rod extending in a longitudinal direction of the rod between the first and second ends of the rod,
- a gripping member, the gripping member being located at the first end of the rod,
- an applicator element near the second end of the rod, the applicator element defining a longitudinal direction of the applicator element at rest, the applicator element having an application portion suitable for applying the cosmetic product,
- a flexible, elastically deformable core, the core connecting the applicator element to the rod, wherein:

- the core comprises a free portion extending freely between the rod and the application portion of the applicator element, the free portion of the core having a length of at least 2 mm, preferably at least 3 mm, more preferably at least 5 mm, the core allowing maximum bending of the applicator element relative to the rod such that a maximum bending angle between the longitudinal direction of the bent applicator element and the longitudinal direction of the applicator element at rest is at least 1°, or even at least 2°, preferably at least 5°, more preferably at least 10°.

Thus, advantageously, the applicator device according to the invention has a flexible applicator element improving comfort during use, with no loss of precision in such application.

In addition, the applicator device according to the invention is of simpler design. The applicator device may in particular have dimensions substantially identical to those of known applicator devices. It is therefore not necessary to provide a cosmetic product container of specially adapted shape; a known container can be used. The applicator device therefore does not result in any additional costs in packaging and/or in its assembly process.

The proposed solution also eliminates any constraints on the choice of materials of the applicator element, depending on the product to be applied.

According to some preferred embodiments, the applicator device according to the invention comprises one or more of the following characteristics, alone or in combination:

- the rod is rigid;
- the maximum bending angle is at most 30°, preferably at most 20°;
- the core has a cross-section, the cross-section of the core has a diameter, the rod has a cross-section, the cross-section of the rod has a diameter, the diameter of the cross-section of the core being less than or equal to, preferably strictly less than, the diameter of the cross-section of the rod;
- the rod has a housing extending in the longitudinal direction of the rod between a bottom of the housing and an outlet of the housing at the second end of the rod, the application portion of the applicator element protruding from the housing, the core extending into the housing with transverse clearance;

the core is fixed in a hole that opens at the bottom of the housing, the core preferably being gripped in the hole;

the housing is tubular, the housing having a length measured between the bottom of the housing and the outlet of the housing, and a diameter measured in a plane transverse to the length, the length of the housing preferably being between 2 and 10 mm and/or the diameter of the housing preferably being between 1 and 5 mm;

the housing is frustoconical, the housing having a length and a maximum diameter, measured in a plane transverse to the length, at the end of the rod, the length of the housing preferably being between 2 and 10 mm and/or the maximum diameter of the housing preferably being between 1 and 5 mm;

the core comprises, preferably consists of, a twisted wire, the application portion being formed by tufts of bristles gripped by the twisted wire;

the core extends in a longitudinal direction of the applicator element at rest and the tufts of bristles extend transversely to the longitudinal direction of the applicator element at rest;

the tufts of bristles have a longitudinal position on the core and a length measured transversely to the longitudinal direction of the applicator element, the length of the tufts of bristles being a function of the longitudinal position on the core, the length of the tufts of bristles being in particular a decreasing function on at least a portion of the core, located outside the housing and the hole, when there are such;

the core has a short-bristled portion, preferably received in the housing, said short-bristled portion being distinct from the application portion of the applicator element, said short-bristled portion in particular having tufts of bristles shorter than the tufts of bristles of the application portion, more preferably of a length such that clearance is maintained between the tufts of bristles of the short-bristled portion and the wall or walls of the housing in the rod;

the wire has a diameter greater than or equal to 0.3 mm, preferably greater than or equal to (14 mm, and/or less than or equal to 0.7 mm, preferably less than or equal to 0.6 mm;

the applicator element has an application portion provided with spikes and/or flocked;

the applicator element has a base portion contiguous with the application portion, preferably one piece with the application portion, the base portion preferably being received in the housing, more preferably with transverse clearance;

the applicator element, in particular the application portion, is of flexible material, in particular plastic material;

the core is one piece with the rod;

the core is one piece with the applicator element;

the core is distinct from the rod and from the applicator element;

the core has a diameter greater than 0.3 mm, preferably greater than 0.4 mm; and the core has a diameter less than 2.5 mm, preferably less than 1.5 mm, more preferably less than 0.7 mm, even more preferably less than or equal to 0.6 mm.

The invention also relates to a device for the packaging and application of a cosmetic product to be applied onto keratinous materials, in particular keratinous fibers such as eyelashes or eyebrows, comprising an applicator device as described above in all its combinations, and a container for containing the product to be applied, the applicator device being suitable for fixing to the container such that the applicator element is received inside the container, in contact with the cosmetic product.

Preferably, the container has an opening and the gripping member is suitable be fixed on the container in order to close the opening of the container.

Preferably, the gripping member has a threaded skirt, the container has a threaded neck, the threaded skirt of the gripping member being suitable for screwing onto the threaded neck of the container.

BRIEF DESCRIPTION OF THE DRAWINGS

The invention will be better understood from the description which follows, made with reference to the accompanying drawings, among which.

In the remainder of the description, elements that are identical or of identical function bear the same reference. For brevity in the present description, these elements are not described in the context of each embodiment. On the contrary, only the differences between the embodiments are described.

DETAILED DESCRIPTION OF THE DISCLOSURE

Figure 1:
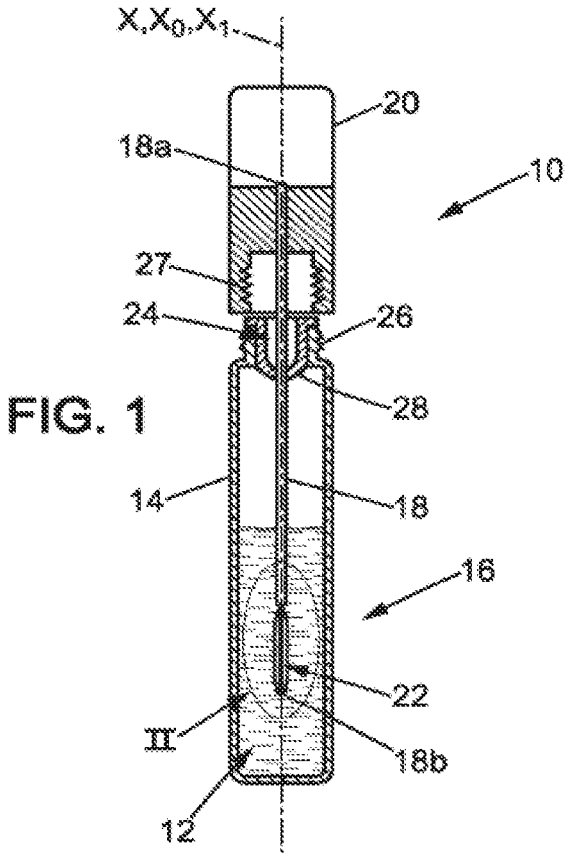
FIG. 1 is a view with partial cutaway of a device for packaging and applying a cosmetic product with a mascara applicator device.

FIG. 1 illustrates a device 10 for packaging and applying a cosmetic product 12 to be applied to keratinous fibers, in particular eyelashes or eyebrows. The cosmetic product 12 is mascara, for example.

This packaging and application device 10 essentially comprises a container 14 containing the cosmetic product 12 to be applied, and an applicator device 16. The applicator device 16 comprises a rod 18 having a first 18*a* and a second 18*b* end. The rod 18 extends in a longitudinal direction $X_0$ between the first end 18*a* and the second end 18*b* of the rod 18. In FIG. 1, the longitudinal direction $X_0$ of the rod is the same as the longitudinal direction X of the container 14, of a gripping member 20 of the applicator device 16, and the longitudinal direction $X_1$ of an applicator element 22 of the applicator device 16 in the position in which this applicator element 22 is shown. The position of the applicator element 22 shown in FIG. 1 is called the "at rest" position, in which the applicator element is not being used to apply a cosmetic product to a keratinous material. The gripping member 20 is fixed at the first end 18*a* of the rod 18. The applicator element 22 is mounted at the second end 18*b* of the rod 18, in other words near this second end 18*b* of the rod 18. Here, the gripping member 20 is substantially cylindrical. The cross-section of the gripping member 20 may in particular be oval, round, or polygonal, for example triangular, square, or rectangular. In addition to enabling the applicator device 16 to be gripped, the gripping member 20 enables the attachment of this applicator device 16 to the container 14, To do this, the container 14, for example of tubular shape having an axis X, has a threaded neck 26 at a mouth 24 adapted to allow the passage of the applicator element 22 and the rod 18. The gripping member 20 is provided with a threaded skirt 27, suitable for screwing onto the threaded neck 26. This attachment thus also allows closing the mouth 24. In this position of the gripping member 20 on the container 14, the rod 18 allows the applicator element 22 to be received in the cosmetic product 12, thus enabling extraction of a portion of the product when the applicator device 16 is withdrawn.

In the example illustrated, the container 14 also comprises wiping ring 28 in the mouth 24, here mounted tightly in the mouth 24. This wiping ring 28 is intended to come into contact with the applicator element 22 when the latter is withdrawn from inside the container 14, in order to eliminate the surplus cosmetic product 12 which could be covering or saturating the applicator element 22.

This wiping ring 28 is optional, however. Similarly, the method of attaching the applicator device 16 by screwing the gripping member 20 onto a threaded neck 26 of the container 14 is only one example among other embodiments that are conceivable to those skilled in the art.

Figure 2:
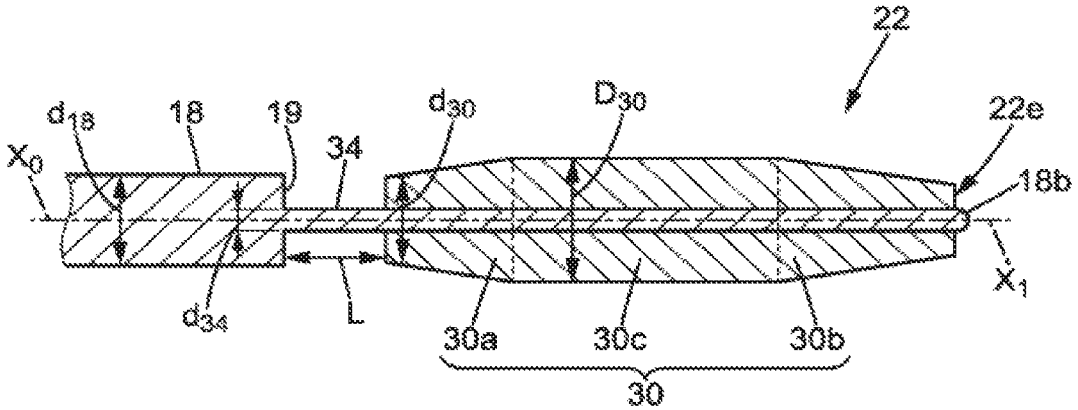
FIG. 2 schematically represents a longitudinal section view of an end of a first example of a cosmetic product applicator device that can be implemented in the packaging and application device of FIG. 1.
Figure 3:
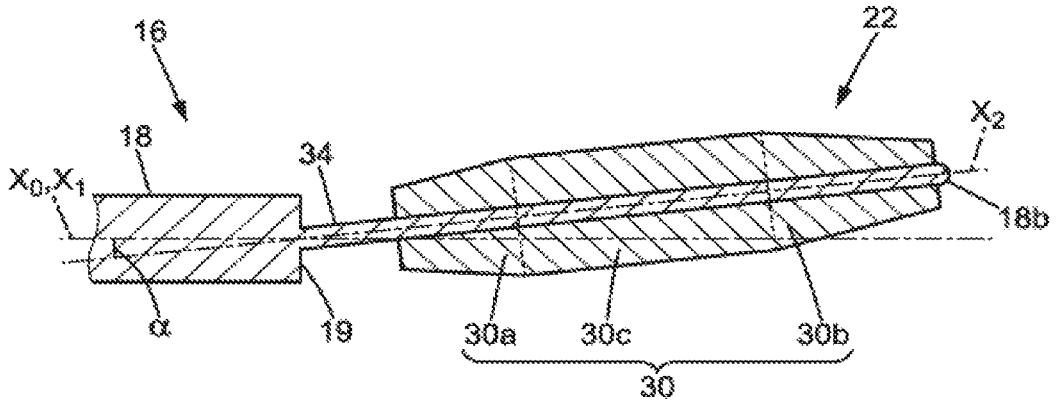
FIG. 3 is a view similar to FIG. 2, showing the bending of the applicator element relative to the rod.

However, FIGS. 2 and 3 illustrate longitudinal section view showing details of the second end 18*h* of the rod 18, where the applicator element 22 is fixed.

As illustrated in FIG. 2, the applicator element 22 is a molded applicator and has an application portion 30, intended to enable the application of cosmetic product 12 onto keratinous fibers. The applicator element 22 is for example of plastic or any other material that allows obtaining an applicator element 22 that is more flexible or more rigid than the rod 18.

The application portion 30 can have any desired shape that allows satisfactory application of cosmetic product, particularly mascara. Here, for example, the application portion 30 defines three contiguous areas:

- a first area 30*a*, closest to the first end 18*a* of the rod 18, of frustoconical shape with the smaller base facing towards this first end 18*a* of the rod 18, the diameter of this smaller base being denoted $d_{30}$;
- a second area 30*b*, furthest from the first end 18*a* of the rod 18, of frustoconical shape, substantially identical to that of the first area 30*a* but with the smaller base facing away from the first end 18*a* of the rod 18, in other words towards the free end 22*e* of the applicator element 22; and
- a third area 30*c*, extending between the first and second areas 30*a*, 30*b*, the third area 30*c* here being substantially cylindrical, of diameter $D_{30}$.

The first, second, and third areas 30*a*, 30*b*, 30*c* may in particular be provided with spikes—not visible in FIGS. 2 and 3—to allow satisfactory application of cosmetic product.

It is noteworthy that the applicator element 22 here is fixed at the second end 18*b* of the rod 18 by means of a flexible core 34, elastically deformable to allow the applicator element 22 to bend relative to the rod 18. More specifically, here the applicator element 22 is overmolded onto the core 34.

In the example of FIGS. 2 and 3, the core 34 is integral with the rod 18. In other words, the core 34 and the rod 18 form a single piece. However, the diameter dis of the rod 18 is chosen to be greater than the diameter $d_{34}$ of the core 34 so that the core 34 is flexible relative to the rigid rod 18. Specifically, the flexible core 34 has a cross-section, the cross-section of the flexible core has a diameter $d_{34}$; the rod 18 has a cross-section, the cross-section of the rod 18 has a diameter dig; and the diameter $d_{34}$ of the cross-section of the flexible core 34 is less than or equal to, preferably strictly less than, the diameter $d_{18}$ of the cross-section of the rod 18. In particular, the diameter $d_{18}$ of the rod 18 may be at least two times greater than the diameter $d_{34}$ of the core 34, preferably at least five times greater. The rod 18 thus has a shoulder 19 from which the core 34 extends.

The rod 18 and the core 34 are, for example and without limitation, made of copolyester, polyethylene (PE), polypropylene (PP), or polyoxymethylene (POM).

The diameter $d_3$ of the flexible core 34 is for example greater than 0.3 mm, preferably greater than 0.4 mm. This diameter $d_{34}$ may additionally or alternatively be less than 2.5 mm, preferably less than 1.5 mm, more preferably less than 0.7 mm, even more preferably less than or equal to 0.6 mm. In particular, the diameter $d_3$ of the core 34 is equal to 0.5 mm.

The core 34 extends from the shoulder 19 of the rod 18 to the second end 18*b* of the same rod 18. In addition, the core 34 extends freely for a length L measured between the shoulder 19 of the rod 18 and the application portion 30 of the applicator element 22.

The length L for which the core 34 freely extends is at least 2 mm, or even at least 3 mm, preferably at least 5 mm. In addition, the core 34 is shaped to allow maximum bending of the applicator element 22 relative to the rod 18, by elastic deformation of the core 34, such that a maximum bending angle $\alpha$ between the longitudinal direction $X_1$ of the applicator element at rest and the longitudinal direction $X_2$ of the bent applicator element 22, measured in a longitudinal plane of the applicator device 16 including the longitudinal direction $X_1$ of the rod 18 and the longitudinal direction $X_2$ of the applicator element 22, is at least 1°, even at least 2°, even at least 5°, or indeed even at least 10°. Here, in the rest position, the applicator element 22 is subjected only to its weight and to the reaction of the core 34. In the flexed position, an additional external force is applied to the applicator element, for example by the keratinous material onto which the cosmetic product is applied.

Thus, the core 34 allows a relative displacement of the applicator element 22 with respect to the rod 18. It should be noted here that because the core 34 is more flexible than the rigid rod 18, it is the core 34 which deforms and not the rod 18 if a force is applied on the applicator element 22. This deformation enables compensating for excessive pressure on the applicator element 22, as such pressure could be painful without this deformation. This deformation thus results in greater comfort during application. In addition, this deformation also allows using an applicator element 22 whose spikes are more rigid, the stiffness of the spikes being particularly advantageous for combing the eyelashes or eyebrows onto which the cosmetic product is applied.

The maximum bending between the applicator element 22 and the rod 18, obtained by elastic deformation of the core 34, is preferably limited. For example, the maximum bending angle $\alpha$ of the applicator element 22, obtained by elastic deformation of the core 34, is at most 30°, preferably at most 20°. Too large of a maximum bending angle $\alpha$ can affect accuracy when applying makeup. Too large of a maximum bending angle $\alpha$ can also result in requiring significant pressure during application, rendering the application of makeup a delicate operation.

Figure 4:
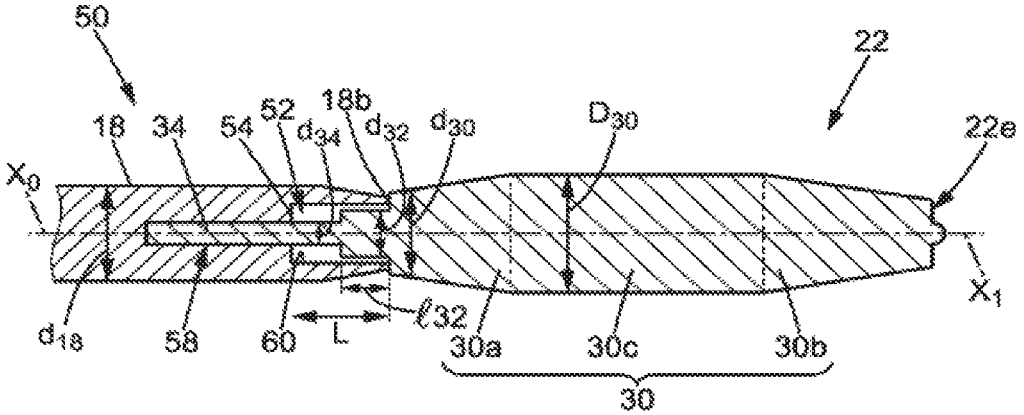
FIGS. 4 and 5 are views similar to FIGS. 2 and 3, of a second example of a cosmetic product applicator device that can be implemented in the packaging and application device of FIG. 1.
Figure 5:
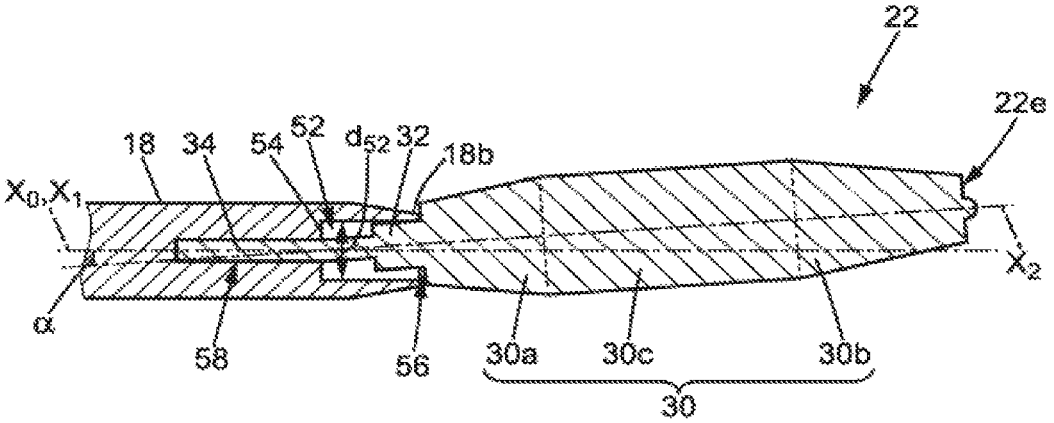

The second example 50 of the applicator device shown in FIGS. 4 and 5 differs from the first example 16 in three main points.

First, in this second example 50, the core 34 is not one piece with the rod 18, but with the applicator element 22. The mounting of the applicator device 50 can then be carried out in two stages: first the applicator element 22 is created with the core 34, then the whole is fixed to the rod 18.

In addition, as illustrated in the figures, the applicator element 22 comprises a base 32 in addition to the application portion 30. This base 32, as illustrated, has a substantially cylindrical shape. The base 32 may in particular have a round cross-section of a diameter $d_{32}$ that is smaller than the diameter $d_{30}$ of the smallest base of the first area 30*a* of the application portion 30. Thus, the cylindrical surface of the base 32 is recessed relative to the surface of the application portion 30, so that the base 32 cannot be in contact with the keratinous material onto which the cosmetic product is to be applied. This prevents the base 32 from being used for applying the cosmetic product, which would affect accuracy when applying the cosmetic product. The base 32 is thus distinct from the application portion 30 of the applicator element 22.

According to the example of FIGS. 4 and 5, the diameter $d_{32}$ of the base 32 is for example at least two times smaller than the diameter $d_{30}$ of the smallest base of the first area 30*a*. The maximum diameter $D_{30}$ of the application portion 30 is for example greater than or equal to the diameter $d_{32}$ of the base 32, for example at least two or even three times larger than the diameter $d_{32}$ of the base 32. In addition, the length of the application portion 30 of the applicator element 22 is greater than or equal to the length $l_{32}$ of the base 32, preferably at least two times greater, more preferably at least five times greater than the length of the base 32, these lengths being measured along the longitudinal direction $X_1$ of the applicator member 22 at rest.

Finally, the rod 18 forms a housing 52. The housing 52 is substantially tubular. The housing 52 extends in the longitudinal direction $X_0$ of the rod 18 between a bottom 54 of the housing 52 and an outlet 56 of the housing 52 at the second end 18 of the rod 18. The housing 52 has a length, measured between the bottom 54 of the housing 52 and the outlet 56 of the housing 52. The length of the housing 52 is for example between 2 and 10 mm, preferably equal to 4 mm. The housing 52 also has a diameter $d_{52}$, measured in a plane transverse to the length of the housing 52. The diameter $d_{52}$ of the housing 52 is preferably between 1 and 3 mm, more preferably equal to 2.5 mm. In the illustrated example, the base 32 of the applicator element is completely received in the housing 52, making the base 32 inaccessible from outside the housing 52. The base 32 therefore cannot be used to apply cosmetic product onto keratinous material of a user, such that the base 32 is distinct from the application portion 30 of the applicator element.

A hole 58 is made in the rod 18, coaxial with the rod 18. The hole 58 outlet is at the bottom 54 of the housing 52. In accordance with the knowledge of those skilled in the art, the diameter of the hole 58 is equal to or substantially less than the diameter of the core 34, in order to be able to mount the core 34 tightly in the hole 58. It is thus possible to fix the core 34, and therefore the applicator element 22, onto the rod 18 in a simple and effective manner. Of course, other assembly techniques known to those skilled in the art can also be implemented.

The length of the hole is for example between 4 and 10 mm, and preferably equal to 6 mm. Because the core 34 is received tightly in the hole 58, the application portion 30 of the applicator element 22 projects out of the housing 52. In addition, transverse clearance is maintained between the core 34 and the side wall 60 of the housing 52. Transverse clearance is also maintained between the base 32 of the applicator element, received in the housing 52, and the side wall 60 of housing 52. Thus, the applicator element 22 is able to bend with respect to the rod 18.

It should be noted here that the portion of the core 34 received tightly in the hole 58 is not considered as extending freely. The length L of the core 34 extending freely in this second example 50 thus comprises the length of the core 34 passing through the housing 52 from the bottom 54 thereof to the base 32 of the applicator element, and the length $l_{32}$ of the base 32, which in this case can be considered as a portion of the core 34, since it is not part of the application portion 30 of the applicator element 22. This length L is again at least 2 mm, or even at least 3 mm, preferably at least 5 min.

In addition, the core 34 is shaped to allow a maximum bending angle $\alpha$ obtained by elastic deformation of the core 34, identical to that of the first example 16, Here, this maximum bending angle $\alpha$ can be defined using the side wall 60 of the housing 52 and the base 32 of the applicator element 22. Advantageously, in fact, the base 32 of the applicator element 22 is deformed, by abutting against the side wall 60, to the desired maximum bending angle $\alpha$. The base 32 comprises for example spikes capable of deforming in order to damp the bending of the core 34, to further improve comfort during use of the applicator element 22.

Variants of this example may of course be considered.

For example, the applicator element 22 may be made of one or more thermoplastic materials, in particular one or more elastomeric thermoplastic materials.

Furthermore, other shapes for the cross-section of the base 32 may be envisaged, in particular an oval shape, so that the bending is different depending on the orientation of the applicator element. Also, according to another variant, the base 32 may be in the extension of the application portion 30, the base 32 and the application portion 30 being for example cylindrical, of the same cross-section, and contiguous or non-contiguous. In this case as well, the base 32 is distinct from the application portion in that this base 32 cannot be used to apply the cosmetic product, unlike the application portion 30. In this case, where the base 32 and the application portion 30 are cylindrical with the same cross-section, the base 32 is then formed by the portion of the applicator element 22 which is not accessible to the keratinous material on which the cosmetic product is to be applied. This portion of the applicator element 22 may for example correspond to the portion of the applicator element 22 received in the housing 52.

Figure 6:
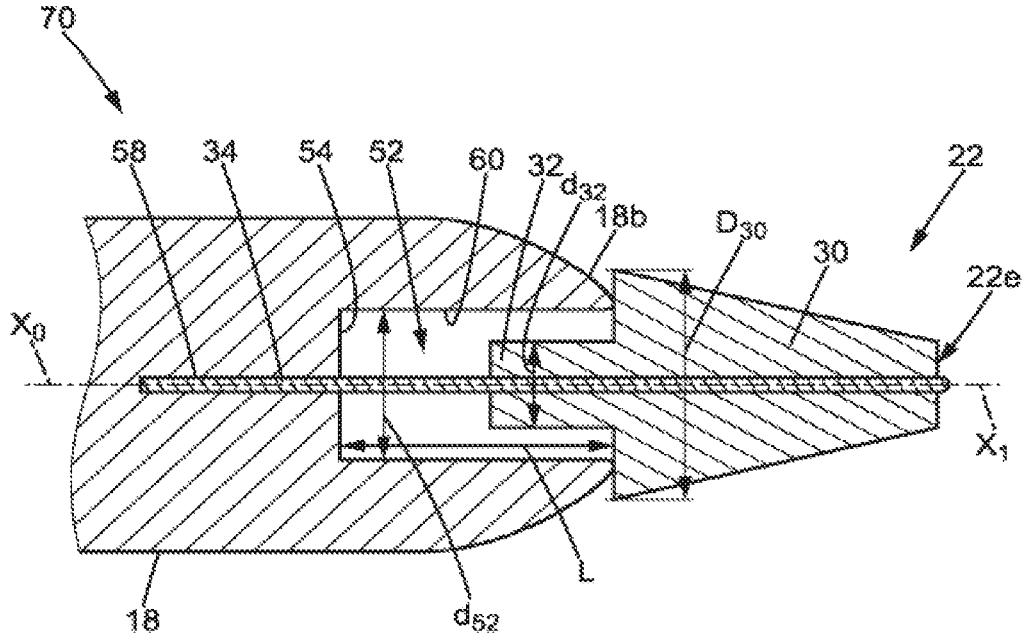
FIGS. 6 and 7 are views similar to FIGS. 2 and 3, of a third example of a cosmetic product applicator device that can be implemented in the packaging and application device of FIG. 1.
Figure 7:
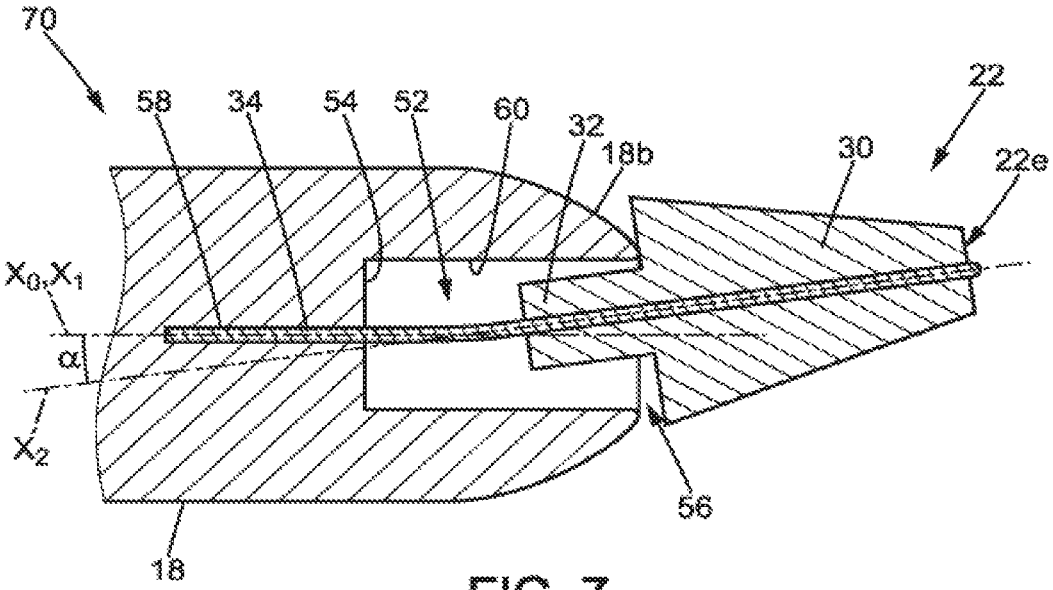

FIGS. 6 and 7 illustrate a third example 70 of an application device that can be implemented in the device 10 for packaging and applying a cosmetic product of FIG. 1.

In this third example 70, the core 34 is not integral with either the rod 18 or the applicator element 22. The core 34 here is a piece separate from the rod 18 and separate from the applicator element 22. The applicator element 22 is overmolded on the core 34. Other modes for fixing the applicator element 22 on the core 34 are possible, however.

The core 34 may be made of thermoplastic material or of metal.

The core 34 is fixed to the rod 18 as described with reference to the second example 50 of FIGS. 4 and 5. The length L of the core 34 which extends freely therefore also comprises the length of the core 34 passing through the housing 52, outside the applicator element 22, and the portion of the core 34 passing through the base 32 of the applicator element 22.

One should note that the geometry of the applicator element 22 is different here from that of the first two examples. Here the application portion 30 comprises only the frustoconical portion 30*c* of the first examples, in which the largest base, of diameter $D_{30}$, faces towards the second end 18*b* of the rod 18. Other shapes of the element applicator and other cross-sections of this applicator element are conceivable.

Figure 8:
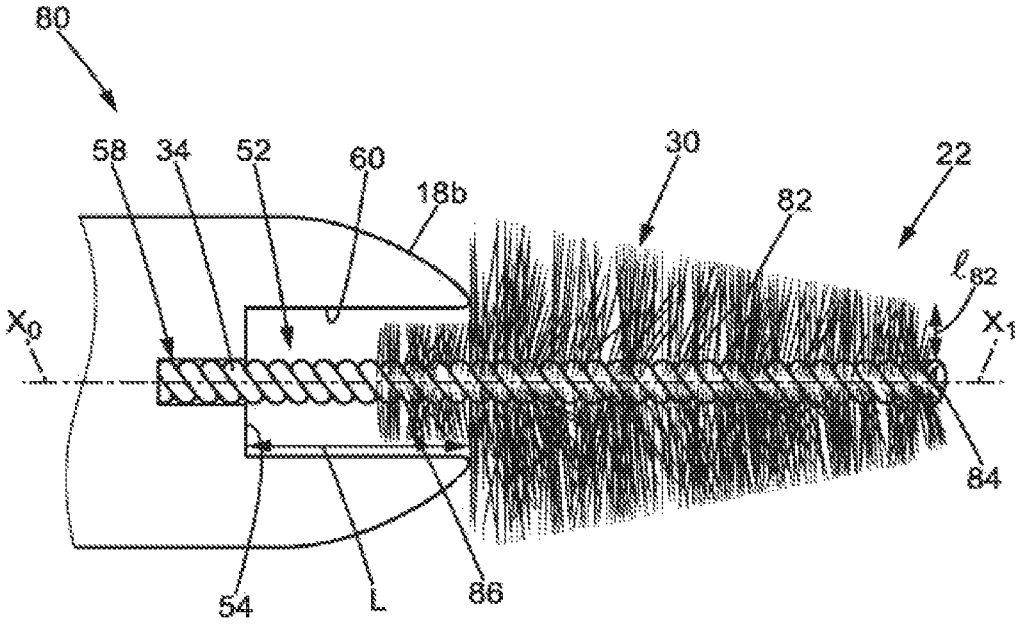
FIG. 8 shows a partial longitudinal section view of a fourth example of a cosmetic product applicator device that can be implemented in the packaging and application device of FIG. 1.

FIG. 8 illustrates a variant 80 of applicator device 70, in which the application portion 30 of the applicator element 22 is formed by tufts of bristles 82 gripped by one or more twisted wires 84, the twisted wire or wires 84 forming the core 34. The twisted wire or wires are for example of stainless steel. The tufts of bristles 82 extend transversely to the longitudinal direction $X_1$ of the applicator element 22, at rest. Advantageously, the tufts of bristles 82 have a longitudinal position on the core 34 and a length $l_{82}$ measured transversely to the longitudinal direction $X_1$ of the applicator element 22, the length $l_{82}$ of the tufts of bristles 82 being a function of their longitudinal position on the core 34. The length $l_{S2}$ of the tufts of bristles 82 may in particular be a decreasing function on at least a portion of the core 34, located externally to the housing 52 and the hole 58, when there are such.

In the illustrated example, the cross-section of the applicator element 22 is centered relative to the core 34. As a variant, the core 34 may also be off-centered relative to the cross-section of the shell surface on at least one point of the application portion. The cross-section of the application portion 30 may in particular be square, rectangular, or oblong. Whatever its shape, the cross-section of the application portion 30 may be centered or off-centered with respect to the core 34.

The diameter of the wire—in other words the diameter of the strand or strands twisted to form the twisted wire—is for example greater than 0.3 mm, preferably greater than 0.4 mm. This diameter of the wire may additionally or alternatively be less than 0.7 him, preferably less than 0.6 mm. In particular, the diameter of the wire is equal to 0.5 mm.

As illustrated, a portion 86 of the core 34 has short bristles. This short-bristled portion 86 is preferably contiguous with the application portion 30 of the applicator element 22. This short-bristled portion 86 is preferably received in the housing 52. The tufts of bristles of this short-bristled portion 86 are preferably of a length less than or equal to the length $l_{82}$ of the tufts of bristles of the application portion. The length of the tufts of bristles of this short-bristled portion 86 is again, preferably, less than or equal to the diameter of the housing 52, in order to maintain a transverse clearance between the tufts of bristles of the short-bristled portion 86 and the side wall 60 of the housing 52. Indeed, the short-bristled portion is not intended to be used to apply cosmetic product. Thus, although contiguous with the application portion 30, the short-bristled portion 86 of the core 34 is distinct from this application portion 30, in that the short-bristled portion cannot be used to apply cosmetic product on keratinous material. Indeed, in this case the keratinous material is not accessible to the short-bristled portion 86, because the latter is received in the housing 52.

The short-bristled portion 86, received in the housing 52, defines the maximum bending angle $\alpha$ by contact with the side wall 60 of the housing. For this definition to be more precise, the tufts of bristles of the short-bristled portion 86 are preferably rigid, in other words more rigid than the tufts of bristles 82 of the application portion 30. The maximum bending angle can thus be defined by the quality, in particular the stiffness, and/or the density of the tufts of bristles of the short-bristled area 86.

Alternatively, the tufts of bristles of the short-bristled portion 86 are more flexible than the tufts of bristles 82 of the application portion 30.

The short-bristled portion 86 thus makes it possible to define the maximum bending angle. In addition, this short-bristled portion 86 makes it possible to control the bending of the core, by the damping induced by the contact of the bristles of the short-bristled portion with the side wall 60 of the housing 52.

As described above, the quality, in particular the stiffness, of the tufts of bristles 82 of the application portion 30 may be different from the quality of the tufts of bristles of the short-bristled area 86. However, the stiffness of the tufts of bristles 82 may be chosen to be relatively high as well, for example to allow combing the eyelashes during the application of mascara, the comfort during application then being ensured by the possible bending of the applicator element 22.

This last embodiment is of particularly simple design, the twisted wire required to fix the tufts of bristles being implemented as the core enabling the applicator element 22 to bend relative to the rod 18. No other intermediate part is necessary.

In the example described, the core 34 is composed of a twisted metal wire 84 in which the bristles are held. The strands of the core 34 may be twisted to the left or to the right. The core 34 may be a double core, formed by two basic cores twisted together. Each basic core may comprise two strands twisted together and gripping the bristles. The two basic cores may each consist of an arm of a single twisted core folded into a U, the two arms being twisted together.

It is also possible to use all kinds of bristles in an applicator element according to the invention, and in particular bristles having a cross-section that is circular or other than circular. In particular a mixture of bristles of different types or a mixture of bristles of different lengths, possibly of the same type or not, may be used.

The bristles may have a diameter of between 6.5 hundredths of a millimeter and 40 hundredths of a millimeter. The cross section of the bristles may in particular be round, oval, polygonal, circular with a flattened side, star-shaped, cross-shaped, U-shaped, H-shaped, T-shaped, V-shaped.

The bristles retained between the twisted strands of the core may have, before placement between the strands of the core, a shape that is or is not rectilinear, for example a wavy shape. The bristles may undergo processing to form balls or forks at their ends.

The bristles may be flocked. The bristles may be made by extruding a plastic material loaded with particles, for example particles of a moisture-absorbing material, to give a microrelief to the surface of the bristles or to give them magnetic or other properties.

The bristles may be natural or synthetic, for example made of a material chosen among: PE, PA, in particular PA6, PA6/6, PA6/10, or PA6/12, HYTREL®, PEBAS®, silicone, PU, this list not being limiting.

Figure 9:
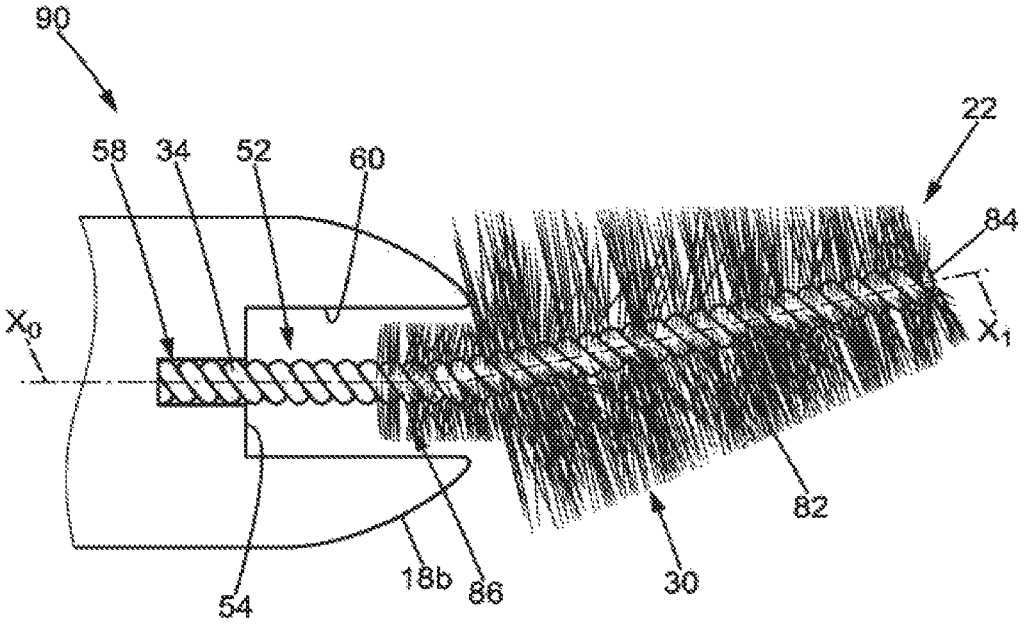
FIGS. 9 and 10 show, in partial longitudinal section views, a fifth example of a cosmetic product applicator device that can be implemented in the packaging and application device of FIG. 1, respectively at rest and in the position for applying a cosmetic product.
Figure 10:
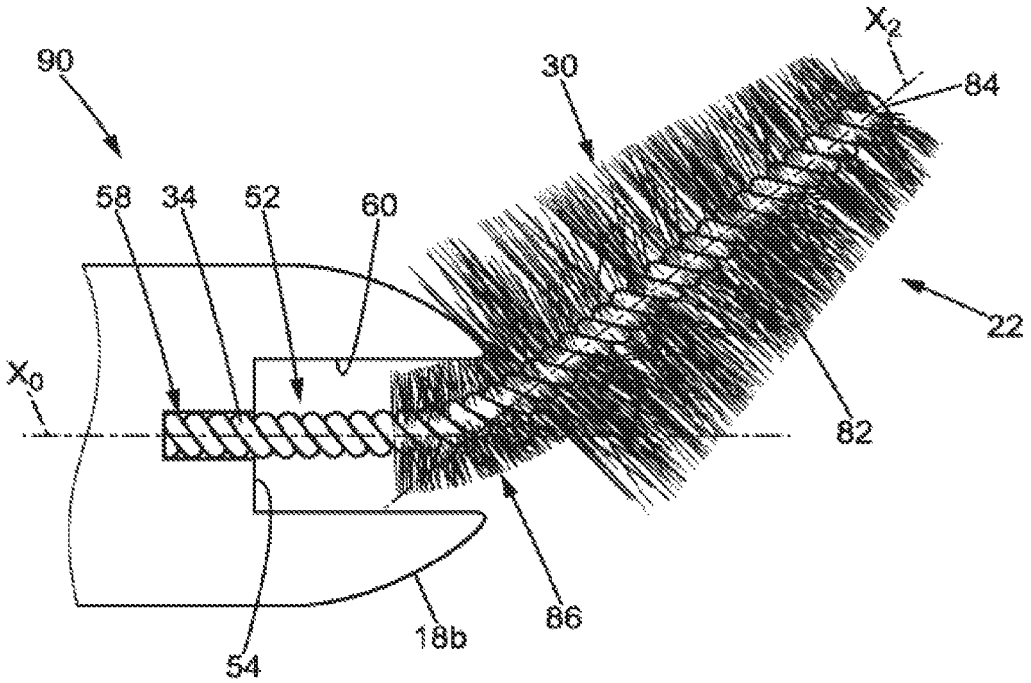

FIGS. 9 and 10 illustrate a variant 90 of the embodiment of FIG. 8. As illustrated in FIG. 9, the longitudinal direction $X_1$ of the applicator element 22 at rest and the longitudinal direction $X_0$ of the rod 18 are not aligned nor parallel. On the contrary, the longitudinal direction $X_1$ of the applicator element 22 here forms, even at rest, a non-zero angle with the longitudinal direction $X_0$ of the rod 18. This enables a particular use of the applicator element 22, particularly by favoring one side of the application portion over another. To obtain a non-flat angle between the longitudinal direction $X_0$ of the rod 18 and the longitudinal direction $X_1$ of the applicator element 22 at rest, the core 34 is bent. In other words, at rest, the core 34 has two substantially rectilinear segments extending in two directions to form a non-flat angle. Alternatively, the core 34 may be bent over at least a portion of its length.

Also in the case of FIGS. 9 and 10, the applicator element 22 can bend when used and the longitudinal direction $X_2$ of the bent applicator element 22 forms an angle with the longitudinal direction $X_1$ of the applicator element 22 at rest, as previously described. The bending may occur locally at the bend formed at rest by the core 34 and/or over some or all of the core extending between the hole 58 and the bend and/or some or all of the core extending between the bend and the free end of the core 34.

It should be noted that, in the case of the example 90 of FIGS. 9 and 10, the longitudinal direction $X_2$ of the bent applicator element 22 may possibly be aligned with the longitudinal direction $X_0$ of the rod 18 or, as illustrated in FIG. 10, form an angle with this longitudinal direction $X_0$ of the rod 18 that is greater than the angle formed by the longitudinal direction $X_1$ of the applicator element 22 at rest, relative to this longitudinal direction $X_0$ of the rod 18.

Figure 11:
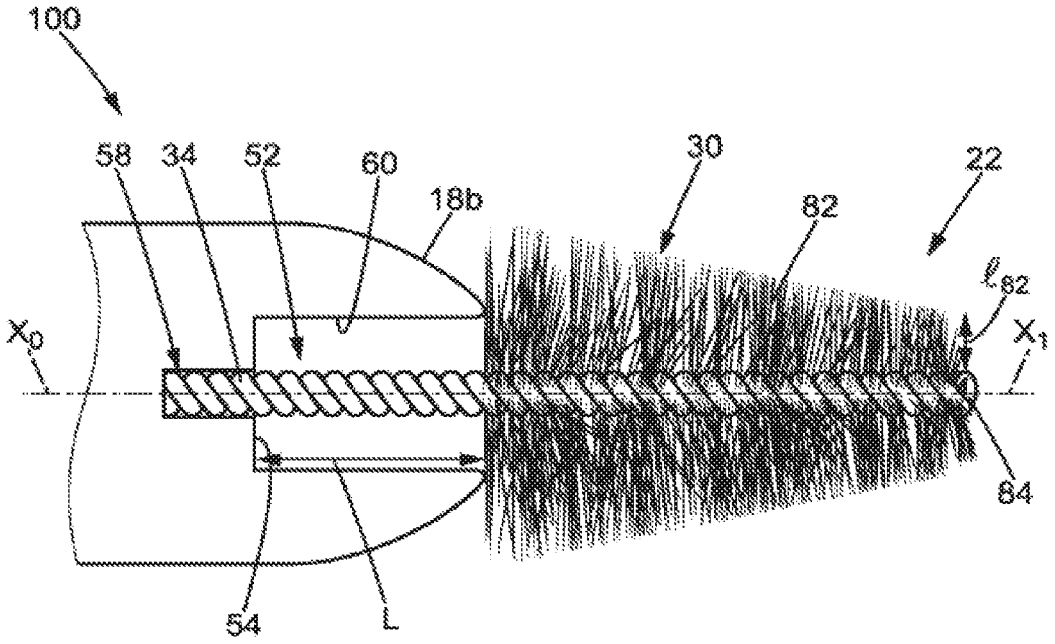
FIGS. 11 and 12 show, in partial longitudinal section views, a sixth example of a cosmetic product applicator device that can be implemented in the packaging and application device of FIG. 1, respectively at rest and in the position for applying a cosmetic product.
Figure 12:
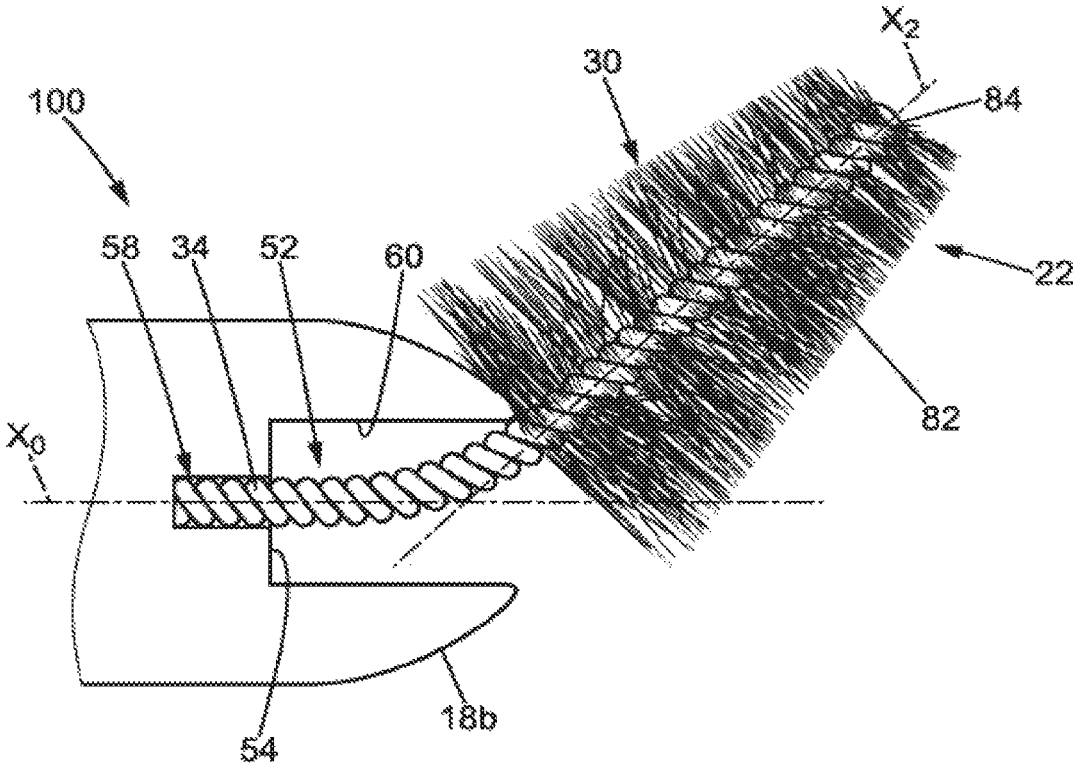

Finally, FIGS. 11 and 12 lustrate a variant 100 of the embodiment of FIG. 8. As illustrated in FIG. 11, and unlike the embodiment of FIG. 8, the core 34 here is without any short-bristled portion 86 received in the housing 52. All the bristles gripped in the core 34 here are therefore part of the application portion 30 of the applicator element 22.

In this case, as shown in FIG. 12, t maximum bending of the applicator element 22 relative to its rest position can be defined by the core 34 coming into abutment against the end of the side wall 60 of the housing 52.

Figure 13:
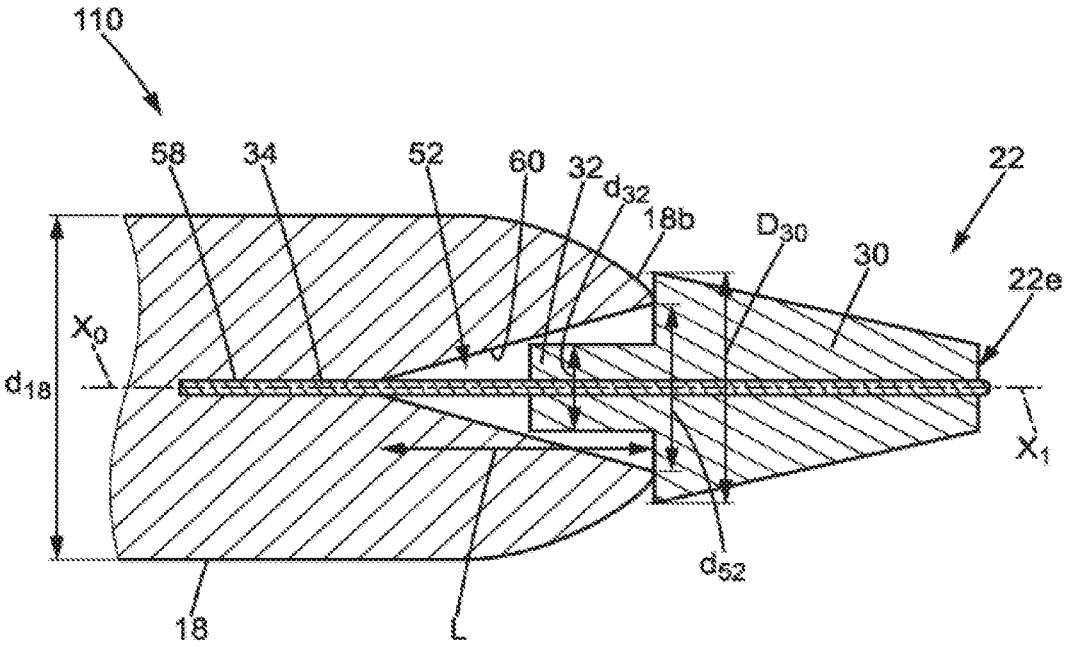
FIGS. 13 and 14 are views similar to FIGS. 6 and 7, of a variant of the third example of a cosmetic product applicator device that can be implemented in the packaging and application device of FIG. 1.
Figure 14:
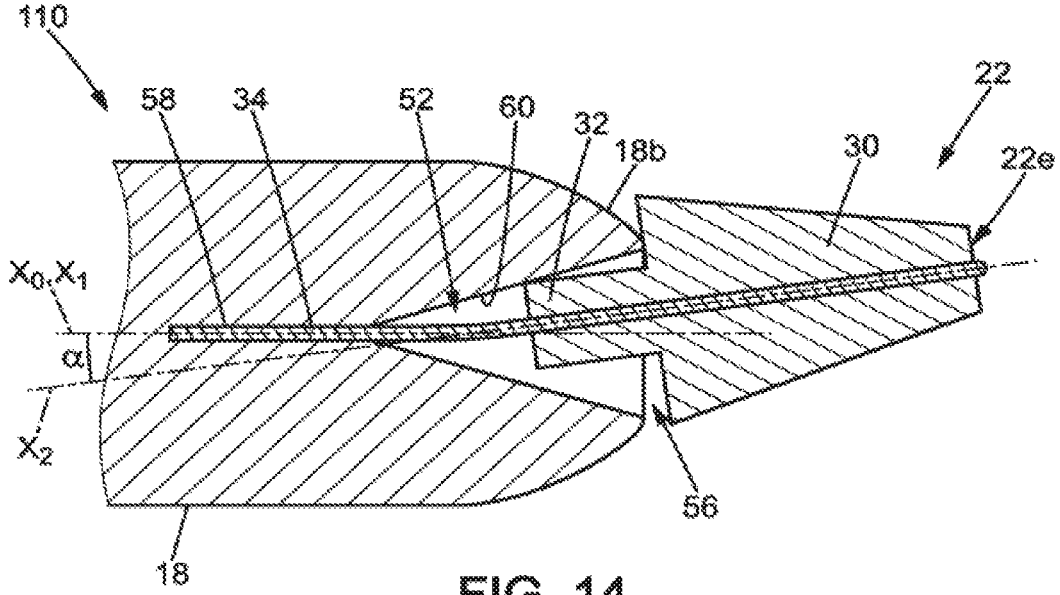

Finally, the example 110 of FIGS. 13 and 14 differs from the example 70 of FIGS. 6 and 7 essentially in that the housing 52 at the end of the rod 18 is frustoconical. Such a frustoconical shape facilitates assembly of the applicator element 30. Indeed, such a frustoconical housing 52 guides the core 34 towards the hole 58 in the rod 18. To do this, it is particularly advantageous that the diameter of the housing 52, measured at its end where the hole 58 opens, is substantially equal to the diameter of the hole 58. The length L of the frustoconical housing 52, measured along the longitudinal direction $X_0$ of the rod 18, corresponds to the length of the freely extending core 34. This length L may be within the value ranges indicated above. In particular, the length of the frustoconical housing 52 may be 10 mm. Finally, the diameter $d_{52}$ of the housing 52, which in the case of a frustoconical housing 52 corresponds to the maximum diameter of the housing 52 measured at the end of the rod 18, may be between 1 and 3 mm, preferably equal to 2.5 mm.

Of course, the frustoconical shape of the housing 52 can be implemented in all the preceding examples where the rod 18 has a housing 52, regardless of the nature of the applicator element 30 and/or the core 34.

In addition, the diameter $d_{18}$ of the rod 18 is for example, in the example 110 of FIGS. 13 and 14, between 3 mm and 4 mm. This value of the diameter $d_{18}$ of the rod 18 can also be applied to the other examples described above.

The invention is not limited only to the embodiments described above with reference to the figures, but on the contrary is suitable for many variants accessible to those skilled in the art.

First, the features of each embodiment y be combined in embodiments that are not shown or described.

Furthermore, the applicator element may be of any suitable type and/or of any geometry suitable for applying cosmetic product to keratinous materials, in particular keratinous fibers such as eyelashes or eyebrows. The applicator may therefore be a flocked applicator.

Also, the rod 18 is substantially cylindrical in the examples described. In particular, the rod 18 is not flared at its second end 18*b* where the housing 52 opens. Such flaring does not appear necessary, as it may make the applicator device 50 more difficult to insert into its container 14. However, such flaring may be provided in some embodiments (not illustrated).

The principle of bending the core 34 is applicable to any cross-section of this core 34: oval, polygonal or other. The shape of the cross-section of the core can give preference to some bending planes of the core over others, which can contribute to a more accurate application of cosmetic product.

In the examples described, the housing 52 is tubular, of substantially circular cross-section. Alternatively, however, the cross-section of the housing 52 may take any other shape, including an ellipse, a polygon, in particular a square or rhombus shape. Depending on the shape of the cross-section of the housing 52, it is possible to have a maximum bending of the applicator element 30 that differs according to the different orientations of the rod.

The invention may also be implemented for applicators other than mascara applicators, for example eye shadow applicators, blush applicators, eyebrow applicators, lip product applicators.

The invention claimed is:

1. An applicator device for applying a cosmetic product onto keratinous materials comprising:

a rod, the rod having a first and a second end, the rod extending in a longitudinal direction of the rod between the first and second ends of the rod, a gripping member, the gripping member being located at the first end of the rod, the rod being rigid, an applicator element near the second end of the rod, the applicator element defining a longitudinal direction of the applicator element at rest, the applicator element having an application portion suitable for applying the cosmetic product, a flexible, elastically deformable core, the core connecting the applicator element to the rod, wherein:

the core comprises a free portion extending freely between the rod and the application portion of the applicator element, the free portion of the core having a length of at least 2 mm, the core allowing maximum bending of the applicator element relative to the rod such that a maximum bending angle between the longitudinal direction of the bent applicator element and the longitudinal direction of the applicator element at rest is at least 1°, and wherein the rod has a housing extending in the longitudinal direction of the rod between a bottom of the housing and an outlet of the housing at the second end of the rod, the application portion of the applicatior element protruding from the housing, the core extending into the housing with transverse clearance, wherein the maximum bending angle between the longitudinal direction of the bent applicator element and the longitudinal direction of the applicator element at rest is defined by abutment of one of the applicatior elment or the core against a side wall of the housing.

2. The applicator device according to claim 1, wherein the maximum bending angle is at most 30°.

3. The applicator device according to claim 1, wherein the core has a cross-section, the cross-section of the core has a diameter, the rod has a cross-section, the cross-section of the rod has a diameter, the diameter of the cross-section of the core being less than or equal to the diameter of the cross-section of the rod.

4. The applicator device according to claim 1, wherein the core is fixed in a hole that opens at the bottom of the housing.

5. The applicator device according to claim 1, wherein the housing is tubular, the housing having a length measured between the bottom of the housing and the outlet of the housing, and a diameter measured in a plane transverse to the length.

6. The applicator device according to claim 1, wherein the housing is frustoconical, the housing having a length and a maximum diameter, measured in a plane transverse to the length, at the end of the rod.

7. The applicator device according to claim 1, wherein the core comprises a twisted wire, the application portion being formed by tufts of bristles gripped by the twisted wire.

8. The applicator device according to claim 7, wherein the core extends in a longitudinal direction of the applicator element at rest and the tufts of bristles extend transversely to the longitudinal direction of the applicator element at rest.

9. The applicator device according to claim 7, wherein the tufts of bristles have a longitudinal position on the core and a length measured transversely to the longitudinal direction of the applicator element, the length of the tufts of bristles being a function of the longitudinal position on the core.

10. The applicator device according to claim 7, wherein the core has a short-bristled portion, said short-bristled portion being distinct from the application portion of the applicator element.

11. The applicator device according to claim 7, wherein the wire has a diameter greater than or equal to 0.3 mm and/or less than or equal to 0.7 mm.

12. The applicator device according to claim 1, wherein the applicator element has an application portion provided with spikes and/or flocked.

13. The applicator device according to claim 12, wherein the applicator element has a base portion contiguous with the application portion.

14. The applicator device according to claim 12, wherein the applicator element is of flexible material.

15. The applicator device according to claim 12, wherein the core is one piece with the rod.

16. The applicator device according to claim 12, wherein the core is one piece with the applicator element.

17. The applicator device according to claim 12, wherein the core is distinct from the rod and from the applicator element.

18. The applicator device according to claim 1, wherein the core has a diameter greater than 0.3 mm.

19. The applicator device according to claim 1, wherein the core has a diameter less than 2.5 mm.

20. A device for packaging and application of a cosmetic product to be applied to keratinous materials, comprising the_applicator device according to claim 1, and a container for containing the product to be applied, the applicator device being suitable for fixing to the container such that the applicator element is received inside the container, in contact with the cosmetic product.

21. The device for packaging and application according to claim 20, wherein the container has an opening and the gripping member is suitable to be fixed on the container in order to close the opening of the container.

* * * * *